United States Patent [19]

Hall

[11] Patent Number: 5,068,167

[45] Date of Patent: Nov. 26, 1991

[54] HIGH CONTRAST PHOTOGRAPHIC MATERIALS

[75] Inventor: Kevin P. Hall, High Wych, Great Britain

[73] Assignee: Minnesota Mining and Manufacturing Company, St. Paul, Minn.

[21] Appl. No.: 174,725

[22] Filed: Mar. 29, 1988

[30] Foreign Application Priority Data

Apr. 2, 1987 [GB] United Kingdom ..... 8707841

[51] Int. Cl.[5] ..... G03C 1/34

[52] U.S. Cl. ..... 430/264; 430/422; 430/608

[58] Field of Search ..... 430/264, 608, 422

[56] References Cited

U.S. PATENT DOCUMENTS

| | | | |
|---|---|---|---|
| 2,935,405 | 5/1960 | Sottysiak | 430/608 |
| 4,221,857 | 9/1980 | Okutsu et al. | 430/264 |
| 4,385,108 | 5/1983 | Takagi et al. | 430/264 |
| 4,536,473 | 8/1985 | Mihara | 430/575 |
| 4,560,638 | 12/1985 | Loblaw et al. | 430/264 |
| 4,618,574 | 10/1986 | Cavallaro | 430/567 |

FOREIGN PATENT DOCUMENTS

| | | |
|---|---|---|
| 0196626 | 10/1986 | European Pat. Off. . |
| 1244818 | 9/1971 | United Kingdom . |

*Primary Examiner*—Charles L. Bowers, Jr.
*Assistant Examiner*—Janet C. Baxter
*Attorney, Agent, or Firm*—Gary L. Griswold; Walter N. Kirn; Mark A. Litman

[57] ABSTRACT

Pepper fog may be reduced in high contrast photographic materials comprising silver halide emulsion in association with a hydrazine by the presence of at least 0.001 mole per mole of silver halide of a water-soluble bromide and/or water-soluble chloride. Suitable water-soluble bromides and chlorides are alkali metal bromides and chlorides which are advantageously added to the silver halide emulsion after physical ripening and washing.

11 Claims, No Drawings

HIGH CONTRAST PHOTOGRAPHIC MATERIALS

FIELD OF THE INVENTION

This invention relates to negative acting silver halide photographic materials capable of producing high contrast silver images. In particular the invention relates to high contrast photographic materials having a reduced propensity to formation of pepper fog.

BACKGROUND OF THE INVENTION

It is often desirable to produce black-and-white photographic images formed by a combination of maximum density areas and minimum density areas e.g. half tone imaging. For such imaging applications a contrast of at least 10 (herein referred to as high contrast) and more typically near or above 20 is employed. An example of high contrast photographic elements having white reflective supports are phototypesetting materials intended to produce black type character images on the white background. An example of high contrast photographic elements having transparent supports are lith films, so called because they are used as contact transparencies for exposing lithographic printing plates. The illusion that some areas of a printed image are of intermediate density is created by the viewer's inability to resolve tiny dots of maximum density and background areas of minimum density that separate them.

The use of hydrazines in the developer and/or photographic elements of high contrast systems to increase speed and contrast is well known and disclosed for example, in British Patent No. 598108, U.S. Pat. Nos. 2322027, 2419974, 2419975, 4166742, 4168977, 4211857, 4224401, 4243739, 4272606, 4272614, 4311781 and 4323643 and in Research Disclosure, Vol. 235. November 1983, Item 23510.

In surface latent image forming silver halide emulsions, the grains which are exposed to light are rendered developable while grains which are not exposed to light are not intended to be developed. Nevertheless some of these unexposed grains develop spontaneously. In full tone imaging the spontaneously developing grains raise minimum density more or less uniformly. Such minimum density levels are referred to as fog and, so long as they remain low are not objectionable.

Pepper fog differs from ordinary fog in that it takes the form of small, maximum density areas randomly distributed on a substantially uniform minimum density background. When a photographic element exhibiting pepper fog is viewed under magnification the impression to the viewer is often that the magnified field of view has been sprinkled with grains of pepper.

Pepper fog is a well recognised problem in high contrast photographic systems and provides a serious problem to the photographic printing plate making process. These black spots are tiny black specks which appear in the area between dots that is not intended to be developed. The tendency to form spots increases and grows on ageing of the photographic material particularly during storage thereof under high temperature and/or high humidity conditions, or as the concentration of the sulfite ion used commonly as a preservative in the developer decreases or as the pH value of the solution increases. The formation of black peppers detracts considerably from the marketability of the product as a photographic material for manufacturing a photographic printing plate. Many efforts have been made to overcome this black pepper problem but improvement in black pepper is often accompanied by decreases in sensitivity and gamma (contrast), and there has been a strong demand for a photographic system with reduced black pepper which does not entail losses of sensitivity and high contrast.

U.S. Pat. Specification No. 4618574 discloses a negative working photographic element capable of producing a high contrast silver image. The element comprises surface latent image forming monodispersed silver halide grains having a mean diameter of less than 0.7 microns a contrast enhancing arylhydrazide, and in an amount sufficient to reduce pepper fog while maintaining high contrast, a polyhydroxybenzene and a carboxyalkyl-3H-thiazoline-2-thione.

European Patent Application, Publication No. 0196626 discloses a silver halide photographic material comprising a support, at least one silver halide emulsion layer and one or more light-insensitive hydrophilic colloid layers, wherein said silver halide emulsion layer or said light-insensitive hydrophilic colloid layer contains a hydrazine derivative, and the photographic material has a film surface pH not higher than 5.8 on the side of said emulsion layer inclusive of said light-insensitive hydrophilic colloid layer. The formation of pepper fog is reduced by maintaining the pH of the film surface on the side of the emulsion layer at a level not more than 5.8.

It is an aspect of the present invention to provide new high contrast photographic materials having a reduced propensity to formation of pepper fog.

SUMMARY OF THE INVENTION

According to one aspect of the invention there is provided a photographic element free of latent image and capable of producing a high contrast silver image comprising a high contrast silver halide photographic emulsion in association with a hydrazine in which the emulsion contains at least 0.001 mole per mole of silver halide of a water-soluble bromide and/or water-soluble chloride.

According to a second aspect of the invention there is provided a method of treating a high contrast photographic silver halide emulsion associated with a hydrazine to reduce the propensity of the emulsion to form pepper fog in which the emulsion is contacted prior to exposure with an aqueous solution of a chloride and/or bromide in an amount of at least 0.001 mole per mole of silver halide.

DETAILED DESCRIPTION OF THE INVENTION

It has been surprisingly found that the addition of water soluble chlorides or bromides to hydrazine containing high contrast photographic silver halide emulsions significantly reduces pepper fog formation. The chlorides and bromides are generally added in an amount in the range 0.001 to 0.2 mole per mole of silver halide preferably 0.005 to 0.1 mole per mole of silver halide, providing reduced pepper fog formation with only slight loss of speed.

Although the use of halides as antifoggants and restrainers is well known especially as developer additives halides have not been used as pepper fog controllers in hydrazine-containing systems. It is disclosed in U.S. Pat. No. 4221857 that the addition of iodide causes an increase in speed, contrast and pepper fog in hydrazine containing emulsions. Whilst halide salts which are antifoggants e.g. N-alkylbenzothiazolium halides are disclosed in U.S. Pat. Nos. 4221857 and 4377634 and halide spectral sensitizing dyes e.g. 5 5'-dichloro-3,3 ,9-triethylthiacarbocyanine bromide are disclosed in U.S. Pat. No. 4618574, have been employed in high contrast photographic materials, these additives are employed in very low concentrations. Furthermore, the effect of such different halide ions e.g., bromide and iodide on such additives appears to be comparable, whereas it has now been found that water soluble bromide and iodide salts at high concentrations have different effects on the photographic properties of high contrast emulsions.

The chlorides and bromides used in the present invention must be water soluble. Suitable compounds comprise alkali metal salts of chlorine and bromine e.g., lithium, sodium and potassium chloride and bromide. Other salts useful for the invention are magnesium, calcium strontium, ammonium and zinc chlorides and bromides. Additionally chloride and bromide salts of organic cations having a molecular weight of up to 350 may be employed.

The making of photographic emulsions involves several distinct processes which are carried out in sequence:

1) The formation and dispersal of the microcrystals of silver halide, including the technological stages of emulsification and physical ripening.

2) The freeing of the emulsion from excess soluble salts by washing, or by coagulation followed by redispersal in a salt-free medium.

3) A heat treatment, known as after ripening, digestion, or chemical sensitising, to obtain the desired light sensitivity.

Several of these processes may be merged into one operation in practice and in some cases one or more steps may be eliminated from manufacturing procedures.

To prepare the light-sensitive dispersion, the silver halide is precipitated and emulsified by reaction of solutions of a halide (e.g. alkali or ammonium halide) and a silver salt (commonly silver nitrate) in the presence of the emulsifying agent, which is generally gelatin. The mixing of the halide and silver solutions is done, preferably, under fixed conditions of temperature, concentrations, sequence of addition, and rates of addition to produce the dispersion. Two precipitation schemes which are used have been called the single-jet and double jet methods. In the single-jet method, all of the halide is in the mixing vessel right from the start, and the silver nitrate solution is gradually added. In the double-jet scheme, the halide solution and the silver nitrate solution are added simultaneously to the gelatin solution which is in the mixing vessel.

Subsequent to or concurrent with the precipitation and emulsificiation process may occur a first ripening, termed physical ripening, which involves maintaining the dispersion in the presence of a solvent for the silver halide to permit the coalescence and recrystallization of the individual particles to the desired crystal (grain) sizes. This ripening stage is intended to establish the grain size and distribution of sizes.

When the desired degree of ripening is reached, additional gelatin may be added and the emulsion cooled and permitted to set to a firm jelly. It is then divided into small fragments, usually by squeezing through a grid under pressure, and the soluble salts and ammonia are washed from the emulsion with chilled water by osmotic diffusion. Alternatively the emulsion may be desalted by coagulation and decantation or some other means.

After washing the emulsion is substantially free of soluble halide, in general the amount of soluble halide left in the emulsion will be less than 0.00025 mole per mole of silver halide.

In accordance with the present invention the water soluble bromide and/or chloride must be present in the emulsion prior to imaging and may be added to the emulsion at any suitable stage in the preparation. Addition will generally be made after the washing stage and may conveniently be added together with any sensitising dye. It is preferred to add the water soluble bromide or chloride prior to coating to avoid extra coating and drying operations, but it is possible to contact a coated emulsion with an aqueous solution of bromide or chloride.

The quantity of water soluble bromide or chloride for the practice of the invention will be greater than the quantity of solublisable bromide or chloride present in the emulsion either from the inherent solubility of the silver chloride or silver bromide, or from free soluble chloride or bromide present after neutralisation of the silver nitrate and washing, or the chloride or bromide present as the anion of a sensitising dye.

The hydrazine compound present in the photographic element may comprise hydrazine or any hydrazine derivative capable of increasing speed and/or contrast of photographic silver halide emulsions. In general suitable hydrazines will have the general formula:

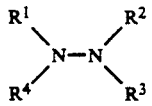

wherein:

$R^1$ is an organic radical, and $R^2$ $R^3$ and $R^4$ each are hydrogen or an organic radical.

Organic radicals represented by $R^1$, $R^2$, $R^3$ and $R^4$ include hydrocarbon groups, such as an alkyl group, an aryl group, an aralkyl group and an alicyclic group and such groups can be substituted with substituents such as alkoxy groups carboxy groups, sulfonamido groups and halogen atoms.

Other examples of hydrazine derivatives are hydrazides, acyl hydrazines, semicarbazides, carbohydrazides and aminobiuret compounds.

The hydrazine compound may be incorporated in the photographic element, for example in a silver halide emulsion layer or in a hydrophilic colloidal layer, preferably a hydrophilic colloidal layer adjacent to the emulsion layer in which the effects of the hydrazine compound are desired. It can of course, be present in the photographic element distributed between the emulsion and the hydrophilic colloidal layers, such as one or more of a subbing layer, interlayers and protective layers.

Hydrazine compounds suitable to be incorporated into the photographic element according to the present invention are disclosed in GB Patent Specification 598108 and in US Patent Specification 2419974; they include the water soluble alkyl, aryl and heterocyclic hydrazine compounds as well as the hydrazide, semicarbazide and aminobiuret compounds.

Particularly preferred hydrazine compounds, for use according to this invention incorporated in the photographic element, are the formylhydrazine compounds corresponding to the formula:

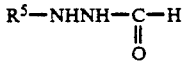

wherein:

$R^5$ represents a substituted or unsubstituted aromatic group.

Examples of aromatic groups represented by $R^4$ include a phenyl group and a naphthyl group. Such aromatic groups may be substituted with one or more substituents which are not electron attracting, such as straight or branched-chain alkyl groups (e.g. methyl, ethyl, propyl, isopropyl, n-butyl, isobutyl, n-octyl, n-hexyl, tert.-octyl n-decyl n-dodecyl, etc.), aralkyl groups (e g. benzyl, phenethyl, etc.), alkoxy groups (e.g. methoxy, ethoxy, 2-methyl-propyloxy, etc.), amino groups which are mono, or disubstituted with alkyl groups acylaminoaliphatic groups (e.g. acetylamino, benzoylamino etc.), as disclosed in US Patent 4168977 and in CA Patent 1146001. Such aromatic groups may also be substituted with a ureido group of formula:

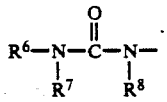

wherein $R^6$ and $R^7$ (which may be same or different) each represents hydrogen; an aliphatic group (such as a straight or branched-chain alkyl group, a cycloalkyl group, a substituted cycloalkyl group, an alkenyl group and an alkynyl group), an aromatic group (such as a phenyl group and a naphthyl group) or a heterocyclic group;

$R^8$ represents hydrogen or an aliphatic group (such as those listed above as described in U.S. Pat. No. 4323643.

Other hydrazine compounds, for use according to this invention incorporated in the photographic element, are those represented by the formula

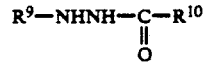

wherein:

$R^9$ represents the same aromatic group of the formula above, and $R^{10}$ represents an alkyl group having 1 to 3 carbon atoms, which may be a straight or branched-chain alkyl (e.g. methyl, ethyl, n-propyl and isopropyl) or a phenyl group. The phenyl group may be substituted with one or more substituents which preferably are electron attracting groups, such as halogen atoms (chlorine, bromine, etc.), a cyano group, a trifluoromethyl group, a carboxy group or a sulfo group, etc. Specific examples of hydrazine compounds represented by the formula above are disclosed in U.S. Pat. Specification No. 4224401.

Still other examples of hydrazine compounds, for use according to this invention incorporated in the photographic element, are those corresponding to the formula:

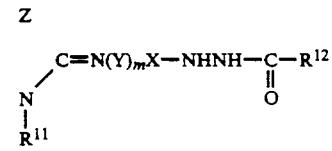

wherein:

$R^{11}$ represents hydrogen, an aliphatic group which may be substituted;

Y represents a divalent linking group;

m represents 0 or 1;

X represents a divalent aromatic group (such as for example a phenylene group, a naphthylene group and the analogous substituted groups thereof);

$R^{12}$ represents a hydrogen atom, an aliphatic group which may be substituted and Z represents the non-metallic atoms necessary to form a 5- or a 6-membered heterocyclic ring. Specific examples of hydrazine compounds represented by the formula above are disclosed in U.S. Pat. No. 4272614.

In one particular preferred form the hydrazine compound to be incorporated in the photographic element is substituted with ballasting groups, such as the ballasting groups of incorporated colour couplers and other non-diffusing photographic emulsion addenda. Said ballasting groups contain at least 8 carbon atoms and can be selected from the relatively non-reactive aliphatic and aromatic groups such as alkyl, alkoxy, alkylphenyl, phenoxy, alkylophenoxy groups and the like.

Such hydrazine compounds can be incorporated in the photographic element using various methods well-known in the photographic art, the most common being the method of dissolving the hydrazine derivatives in a high boiling solvent and dispersing the mixtures in the emulsion, as described for example in U.S. Pat. No. 2322027.

A further class of hydrazines suitable for use in the invention as disclosed in British Patent application No. 8617335 and are of the general formula:

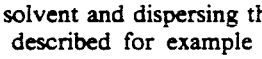

$$R^{13}—NR^{14}—NR^{15}\,G—X \qquad (I)$$

in which:

$R^{13}$ represents an aryl group, one of $R^{14}$ and $R^{15}$ is a hydrogen and the other is selected from hydrogen, arylsulphonyl and trifluoroacetyl, G represents carbonyl, sulphonyl, sulphoxy, phosphoryl or an N-substituted or unsubstituted imino group and, X is hydrogen, alkyl, aryl or a moiety such that at a pH in the range of 9.5 to 12.5 in the presence of an oxidised hydroquinone a cyclisation reaction takes place cleaving the moiety —G—X from the remainder of the molecule and forming a cyclic structure comprising atoms of the moiety —G—X.

It has been found that the particular class of hydrazines provide advantageous properties compared to the hydrazines previously used in the art. In particular, the hydrazines used in the invention provide unexpectedly higher contrast photographic characteristics when developed in a developer having relatively low pH, eg. pH 11, compared to developers used with prior art hydrazines at the same pH. The compounds also provide superior latitude in development pH over prior art compounds This is particularly important because pH changes occur during aerial oxidation of photographic developers in the processing machine.

It is believed that such hydrazines have a different mechanism of action compared to hydrazines previously used in the art. It is postulated that the active fogging agent derived from hydrazines is phenyldiimine and this is formed from the prior art hydrazines by a two stage reaction scheme, firstly an oxidation reaction with oxidised developer and thereafter by hydrolysis. It is believed that the hydrolysis reaction requires high pH in order to occur quickly.

The hydrazines are selected to yield an aryldiimine (eg phenyldiimine) active fogging agent without hydrolysis. Instead the hydrazines are believed to undergo a intramolecular nucleophilic displacement reaction to form aryldiimine and a cyclic structure derived from the moiety —G—X. This reaction proceeds under basic conditions generally within the pH range 9.5 to 12.5.

The types of substituents for the moiety G-X capable of a cyclising reaction will readily be appreciated. Generally X will be represented by the formula $$-(CR^{16}R^{17})_nY$$

in which:

n is 3 or 4,

Y represents OH, SH or $NR^{18}R^{19}$ in which $R^{18}$ and $R^{19}$ are independently selected from hydrogen, or alkyl or aryl groups containing up to twelve carbon atoms;

$R^{16}$ and $R^{17}$ are independently selected from hydrogen, alkyl or aryl or together represent =0, $=NR^{18}$ or the necessary atoms to complete a carbocyclic or heterocyclic ring, additionally 2 or more adjacent $(CR^{16}R^{17})$ groups may form a cyclic structure, each ring having 5, 6 or 7 ring atoms, the cyclic structure having no more than 2 fused rings.

A preferred structure for the moiety X is:

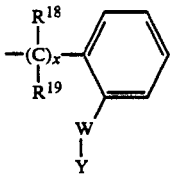

in which:

$R^{18}$ and $R^{19}$ independently represent hydrogen, alkyl or aryl groups each containing up to twelve, preferably up to six carbon atoms; W represents:

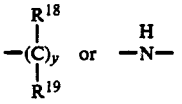

in which $R^{18}$ and $R^{19}$ are as defined above;

Y represents:

—OH,—SH, or $-NR^{18}R^{19}$ in which:

$R^{18}$ and $R^{19}$ are as defined above, and x and y are independently selected from 0, 1 and 2 so that (x+y) =1 or 2;

Group G is preferably C=0.

The above moiety —G—X is capable of cyclising to form a 5 or 6 membered ring eg., lactone or lactam. Specific examples are:

| —G—X Before cyclisation | Cyclised Structure. |
|---|---|
| 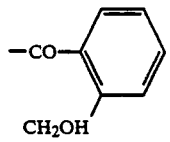 | 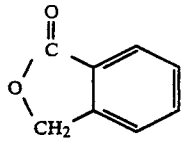 |
| 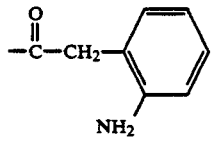 | 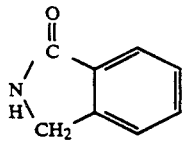 |
| 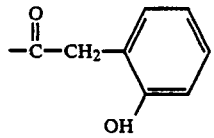 | 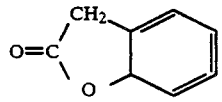 |
| 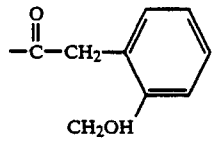 | 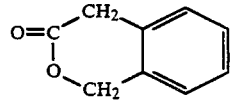 |

It will be noted that the moiety W—Y is electron donating. The phenyl ring may optionally possess other substituents.

When the groups $R^{16}$ and $R^{19}$ are alkyl, the alkyl group may be straight chained or branched and generally contains up to 12 carbon atoms, preferably no more than 3 carbon atoms. When the groups $R^{16}$ to $R^{19}$ are aryl the groups generally contain from 5 to 12 carbon atoms and may optionally include substituents such as alkyl, alkoxy etc.

$R^{13}$ is aryl, generally a monocyclic or bicyclic aryl group. An example of a monocyclic aryl group is a phenyl group and a suitable example of a bicyclic aryl group is a naphthyl group. The aryl group may be substituted with one or more substituents which are not electron-attracting, such as alkyl groups having 1 to 20 carbon atoms (which may be straight or branched chained, e.g., methyl, ethyl, propyl, iso-propyl, n-butyl, iso-butyl, n-octyl, n-hexyl, tert-octyl, n-decyl, n-dodecyl, etc.), aralkyl groups having 1 to 3 carbon atoms in the alkyl moiety thereof (e.g., benzyl, phenethyl, etc.), alkoxy groups having 1 to 20 carbon atoms (in which the alkyl moiety may be straight or branched chain, e.g., methoxy, ethoxy, 2-methylpropoxy, etc.), amino groups which are mono- or disubstituted with alkyl groups having 1 to 20 carbon atoms, aliphatic acylamino groups having 2 to 21 carbon atoms or aromatic acylamino groups (e.g., acetylamino, octynoylamino, benzoylamino, dimethylamino, etc.), etc.

Preferably $R^{13}$ represents

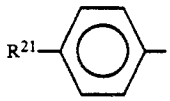

in which $R^{21}$ is hydrogen or an alkyl group of 1 to 12 preferably 1 to 5 carbon atoms such as n-butyl.

The preferred class of compounds has the formula

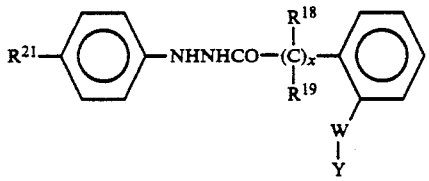

in which:

$R^{18}$ $R^{19}$, $R^{21}$, W, Y and x are as defined above.

A preferred hydrazine for use in the invention is 1-(2'hydroxymethylbenzoyl)2 phenyl hydrazine. This compound after oxidation may readily undergo the following intramolecular nucleophilic displacement to form phenyl diimine and a lactone:

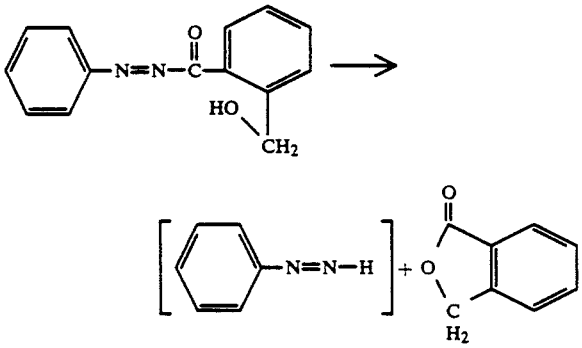

Further preferred hydrazines for use in the invention are of the formula:

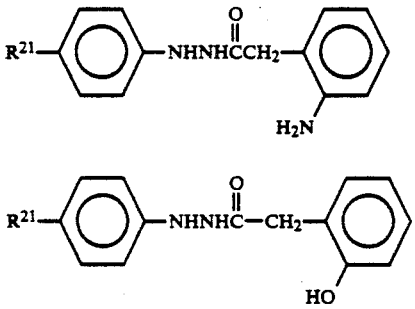

in which:

$R^{21}$ is as defined above.

The hydrazines may be added to the silver halide photographic emulsion at any desired period from the initiation of chemical ripening to before coating, but it is preferred to add the compound after finishing chemical ripening. It is particularly preferred to add the compound to a coating composition prepared for coating.

It is preferred that the hydrazine be incorporated in an amount of from $10^{-6}$ mol to $10^{-1}$ mol, and preferably from $10^{-5}$ mol to $2\times10^{-2}$ mol per mol of silver halide but it is desirable to select the optimum amount of the compound according to the grain size of silver halide emulsion, the halogen composition, the manner and extent of chemical sensitization, and the kind of antifoggant compounds. The most appropriate compound and amount thereof for a particular use can be easily selected by general tests well known to persons skilled in the art.

It is preferred that silver halide grains used for at least one silver halide emulsion layer in this invention be of substantially surface latent image type.

The silver halide emulsion used in the invention may comprise any of silver chloride, silver chlorobromide, silver iodobromide, silver iodochlorobromide, etc., but preferably contains at least 60 mol% silver bromide. The silver iodide content is preferably not more than 10 mol% and more desirably is in the range of from 0.1 to 5 mol%.

In regard to the average grain size of silver halide used in accordance with this invention, fine grains (for example, 0.7 micron or less) are preferable, and very fine grains of average diameter not larger than 0.5 micron are particularly preferable. While the choice of grain size distribution is optional, a monodispersion is preferable. The term "monodispersion" as used herein means that, whether in weight or in number, at least 95% of grains are sized within ±40% of the mean grain size.

The silver halide grains in the photographic emulsion may be regular crystals such as cubes or octahedra, or irregular crystals such as spheres or plates (tabular grains), or composites Each of the silver halide grains may be made up of a uniform phase through its core and surface layer, or may be dissimilar in phase between the core and the surface. It is also possible to use two or more independently prepared silver halide emulsions as a mixture.

In the course of formation of silver halide grains or in the process of physical ripening, there may be added to the silver halide emulsion a cadmium salt, sulfite, lead salt, thallium salt, rhodium salt or rhodium complex salt, iridium salt or iridium complex salt, or the like. Gelatin is preferably used as the binder or protective colloid for the photographic emulsion, but other hydrophilic colloids can also be employed.

For example, gelatin derivatives, graft copolymers of gelatin to other high polymers, proteins such as albumin and casein, cellulose derivatives such as hydroxyethyl cellulose, carboxymethyl cellulose, cellulose sulfate esters, etc., sugar derivatives such as sodium alginate, starch derivatives, etc., and synthetic homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

The silver halide emulsion may be chemically sensitized. Known methods for chemical sensitization of silver halide emulsions include sulphur sensitization, reduction sensitization and noble metal sensitization, and the chemical sensitization may be effected by any or a combination of such methods.

The usual method of the noble metal sensitization is gold sensitization and for this purpose, a gold compound generally a complex salt of gold, is utilized. Complex salts of other noble metals such as platinum, palladium, rhodium, etc., may be additionally contained. Examples of this method are described in U.S. Pat. No. 2448060 and British Patent 618061.

Sulphur sensitizers include, in addition to sulphur compounds contained in gelatin, various sulphur compounds such as thiosulphates, thiourea compounds, thiazole, and rhodanines.

Reduction sensitizers include stannous salts, amines, formamidinesulfinic acid, silane or borane compounds and the like.

For the purpose of increasing the sensitivity of the photographic material of this invention, sensitizing dyes for example, cyanine dyes, merocyanine dyes, etc. can be added to the photographic material.

While these sensitizing dyes may be used alone, they can also be used in combination and such a combination of dissimilar sensitizing dyes are often utilized for supersensitization. Besides these sensitizing dyes dyes which do not have their own spectral sensitizing function or substances which do not substantially absorb visible light but supersensitize the sensitizing dyes may also be included in the emulsion.

Useful sensitizing dyes combinations of dyes which show supersensitization and supersensitizing additives are mentioned in Research Disclosure RD No. 17643 (December, 1978), page 23, IV-J.

The photographic elements may include a variety of compounds for the prevention of fog during production, storage or photographic processing or for the purpose of stabilising its photographic qualities. Thus, for example, there may be added the compounds referred to commonly as antifoggants or stabilizers, for example various azole compounds such as benzothiazolium salts, nitroimidazoles, chlorobenzimidazoles, bromobenzimidazoles, mercaptothiazoles, mercaptobenzothiazoles, mercaptothiadizazoles, aminotriazoles, benzothiazoles, nitrobenzothiazoles, etc.; mercaptopyrimidines, thioketo compounds such as oxazolylthione, etc.; azaindenes such as triazaindene, tetraazaindenes (particularly, 4 hydroxy-substituted-(1,3,3a 7)tetraazaindenes), pentaazaindenes, etc. benzenethiosulphonic acid, benzenesulphinic acid, benzenesulphfonamide, etc. Amongst these compounds, benzotriazoles (e g.,5 methylbenzo triazole) and nitroindazoles (e.g., 5-nitroindazole) are preferred. These compounds may also be incorporated in the processing solution.

The photographic elements may contain inorganic or organic hardening agents in the photographic emulsion layer or other hydrophilic colloid layer. For this purpose, chromium salts (chrome alum, chromium acetate, etc.), aldehydes (formaldehyde, glyoxal, glutaraldehyde etc.), N-methylol compounds (dimethylolurea, methyloldimethylhydantoin, etc.), dioxane derivatives (2,3-dihydroxydioxane, etc.), active vinyl compounds (1,3,5 triacryloyl-hexahydro-s-triazines, 1,3,-vinylsulfonyl-2-propanol, etc.), active halogen compounds (2,4 dichloro-6 hydroxy-s-triazine, etc.), mucohalogenic acids (mucochloric acid, mucophenoxy-chloric acid, etc.), and the like. These hardening agents may be incorporated alone or in combination.

In the photographic emulsion layer or other hydrophilic colloid layer in the photographic material produced in accordance with this invention, a variety of surface active agents may be incorporated for various purposes such as improvement of coating properties antistatic properties slipping properties, emulsion dispersibility, antiadhesion properties and photographic properties (for example, development acceleration, increase in contrast, sensitization, etc.).

Examples of nonionic surfactants are saponin, alkylene oxide derviatives e.g., polyethylene glycol polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamines or amides, silicone polyethylene oxide adducts), glycidol derivatives (e.g., alkenylsuccinic acid polyglyceride, alkylphenol polyglyceride), polyhydric alcohol-fatty acid esters, sugar alkyl esters, etc.. Anionic surfactants containing acid groups such as a carboxyl group, a sulfo group, a phospho group, a sulfuric acid ester group, a phosphoric acid ester group, etc., for example alkylcarboxylates, alkylsulphonates, alkylbenzenesulphonates, alkylnaphthalensulphonates, alkylsulphuric acid esters, alkylphosphoric acid esters N-acyl-N-alkyltaurines, sulphosuccinic acid esters, sulfoalkylpolyoxyethylene alkylphenyl ether, polyoxyethylene alkylphosphoric acid esters, etc.; amphoteric surfactants such as amino acids, aminoalkylsulphonic acids, aminoalkylsulphuric or phosphoric acid esters, alkylbetaines, amine oxides etc., may also be used. Cationic surfactants such as alkylamines, aliphatic or aromatic quaternary ammonium salts, heterocyclic quaternary ammonium salts such as pyridinium salts, imidazolium salts, etc., aliphatic or heterocyclic ring-containing phosphonium or sulphonium salts, etc. may be included.

In the photographic emulsion layer or other hydrophilic colloid layer of the photographic material according to this invention, matting agents such as silica, magnesium oxide, polymethylmethacrylate, etc., may be incorporated for the purpose of preventing adhesion.

The support of the photographic element may be made of cellulose triacetate, cellulose diacetate, nitrocellulose, polystyrene, polyethylene terephthalate or the like. However, the use of polyethylene terephthalate is particularly useful.

Suitable developer compositions for use in the invention are any of those known in the art for development of hydrazine containing rapid access lith films and will generally have a pH in the range 9.5 to 12.5.

Thus, the silver halide photographic elements provide a sufficient ultra-high contrast negative image using a developer containing at least 0.15 mol/liter of sulphite ion as a preservative, and having a pH value in the range of from 10.5 to 12.3 and particularly preferably in the range of from 11.0 to 12.3.

There is no particular limitation on the developing agents that can be employed in the method of this invention. Thus, for example, dihydroxybenzenes (e g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), etc., can be used alone or in combination.

The silver halide photographic element is especilly suitable for processing with a developer containing a dihydroxybenzene compound as the developing agent and a 3-pyrazolidone compound or an aminophenol compound as the auxiliary developing agent. The preferred concentrations of these compounds in the developer are from 0.05 to 0.5 mol/liter for the dihydroxybenzene, and 0.06 mol/liter or less for 3-pyrazolidone or aminophenol.

As described in U.S. Pat. No. 4269929, amine compounds may be added to the developer to thereby increase the rate of development thereby reducing development time.

In addition to the foregoing compounds, there may be added to the developer other additives including pH buffers such as sulphites, carbonates, borates, and phosphates of alkali metals, development restrainers or antifoggants such as bromides, iodides and organic antifoggants (preferably nitroindazoles and benzotraizoles). If desired, water softeners solubilizing agents or cosolvents, toners, development accelerators, surfactants (preferably aforesaid polyalkylene oxides), antifoams hardeners, and silver stain inhibitors (e.g., 2-mercaptobenzimidazolesulphonic acids) may also be incorporated in the developer.

As a fixing bath, a solution of the conventional composition may be employed. Thiosulphates. thiocyanates, and those organic sulfur compounds which are generally known to be effective fixing agents can be used as fixing agents in the bath. The fixing bath may contain a water soluble salt of aluminium or the like as a hardener.

A stop bath e.g. 1% acetic acid solution may be employed. The processing temperature is generally selected within the range of from 18° C. to 50° C.

For photographic processing, an automatic developing machine is desirably used, and a sufficient ultrahigh contrast negative image can be obtained even with a processing time, i.e , the time from entry of the photographic material into the machine to exit from the machine of from 90 to 120 seconds.

The invention will now be illustrated by the following Examples.

EXAMPLES 1 TO 3

A silver halide emulsion having a halide mole percentage ratio of 68:30:2 of Br:Cl:I was prepared by a conventional double jet technique under constant pAg conditions. The resulting emulsion had a narrow grain size distribution with an average size of 0.25 microns. The emulsion was then coagulated and washed, being reconstituted to 95g gelatin per mole of silver.

The emulsion was chemically sensitised with sodium thiosulphate. It was then coated onto clear polyester photographic base of 4 mil thickness at a silver coating weight of 3.5g per square meter. An aqueous solution of a metal halide was then added as shown, with anionic wetting agent (Hostapur), polyoxyethylene cetyl ether (surfactant), a green sensitizing dye [anhydro-5,5'dichloro-9-ethyl-3'bis(3-sulphopropyl)oxacarbocyaninehyd razide sodium salt], a contrast promoting agent (benzhydrol) and a hydrazide derivative

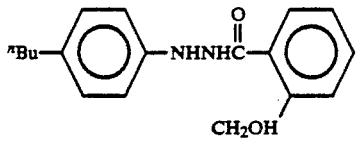

The order of addition was not found to be critical but preferably the halide was added first.

A gelatin top coat was applied comprising 50g gelatin per 1000g water, wetting agent, matting agent (silica), and a hardener (2-hydroxy-4,6-dichloro-1,3,5-triazine).

Samples of the film were then exposed in a sensitometer to light from a tungsten filament lamp attenuated by a 0 to 2.2 continuous neutral density wedge in contact with the coating. The coatings were then developed for 30 seconds at 38° C. in a developer of the following composition:

| | |
|---|---|
| Water | 1800 g |
| Potassium hydroxide | 195 g |
| Potassium metabisulphite | 124 g |
| Diethylenetriaminepentaacetic acid 5Na | 10 g |
| Pyruvic acid sodium salt | 7.5 g |
| Hydroquinone | 60 g |
| Metol | 5.0 g |
| 5 Methylbenzotriazole | 0.2 g |
| Potassium bromide | 9.25 g |
| Potassium chloride | 2.7 g |

After development the samples were fixed, washed and dried. Sensitometric characteristics are given below together with an assessment of pepper fog.

Pepper fog was measured in an apparatus which counted the number of spots of fog over a given area. The figures quoted give a relative indication of the degree of pepper fog.

The toe contrast was measured between densities of 0.07 and 0.17 above fog.

The mid contrast was measured between 0.17 and 0.37 above fog.

| Example | Volume of 1M Lithium Chloride in ml (per mole of silver) | Rel. Speed in log E units | Toe Contrast | Mid Contrast | Pepper level |
|---|---|---|---|---|---|
| COMPARISON | 0 | 1.27 | 2.3 | 6.8 | 67 |
| 1 | 2 | 1.25 | 3.8 | 9.9 | 33 |
| 2 | 4 | 1.24 | 4.3 | 10.7 | 15 |
| 3 | 8 | 1.23 | 4.0 | 10.8 | 8 |

It will be seen that addition of lithium chloride causes a reduction in pepper fog with only slight speed loss.

EXAMPLES 4 TO 7

Emulsions as described in Examples 1 to 3 were prepared but with the addition of 1M potassium bromide aqueous solution in place of the lithium chloride.

Dot quality was measured microscopically on an evaluation scale of 1 (highest quality) to 5 (lowest quality). Scores of 2 or below indicate that the product has valuable commericial properties. A score of 3 indicates that the product is of moderate quality but is marginally usable. As score of 4 or higher indicates unacceptability.

| Example | Volume of 1M potassium bromide in ml (per mole of silver) | Speed in log E units | Toe Contrast | Dot Quality |
|---|---|---|---|---|
| COMPARISON | 0 | 1.53 | 1.5 | 4 |
| 4 | 2 | 1.45 | 1.5 | 3 |
| 5 | 4 | 1.39 | 2.0 | 2 |
| 6 | 8 | 1.28 | 2.5 | 1 |
| 7 | 10 | 1.25 | 3.5 | 1 |

The effect of adding the soluble halide solutions can be seen to cause an increase in the toe contrast (giving better dot quality) with only a slight speed loss.

Further experiments undertaken by adding comparable amounts of 1M potassium iodide solution showed that there was a gross increase in pepper fog and increase in speed. The coated emulsions showed development to maximum density which did not allow quantitative sensitometric evaluation.

I claim:

1. A photographic element free of latent image and capable of producing a high contrast silver image comprising a washed high contrast silver halide photographic emulsion on a clear photographic base, said emulsion containing a hydrazine, said emulsion also comprising at least 0.001 mole per mole of silver halide of a water-soluble bromide and/or water-soluble chloride.

2. A photographic element as claimed in claim 1 characterised in that the water soluble chloride and/or bromide comprises an alkali metal chloride or bromide and is present in an amount of from 0.001 to 0.2 mole per mole of silver halide.

3. A photographic element as claimed in claim 2 characterised in that the alkali metal chloride or bromide is selected from potassium bromide, potassium chloride, sodium bromide, sodium chloride, lithium bromide, lithium chloride and mixtures thereof.

4. A photographic element as claimed in claim 1 characterised in that the water soluble bromide or chloride is present in an amount of from 0.005 to 0.05 mole per mole of silver halide.

5. A photographic element as claimed in claim 2 characterised in that the hydrazine is of the general formula:

$$R^{13}—NR^{14}—NR^{15}—G—X \quad (I)$$

in which:

$R^{13}$ represents an aryl group, one of $R^{14}$ and $R^{15}$ is a hydrogen and the other is selected from hydrogen, arylsulphonyl and trifluoroacetyl, G represents carbonyl, sulphonyl, sulphoxy, phosphoryl or an N-substituted or unsubstituted imino group and X is hydrogen alkyl, aryl or a moiety such that at a pH in the range of 9.5 to 12.5 in the presence of an oxidised hydroquinone a cyclisation reaction takes place cleaving the moiety —G—X from the remainder of the molecule and forming a cyclic structure comprising atoms of the moiety —G—X.

6. The photographic element of claim 1 in which said clear photographic base is selected from the group consisting of cellulose triacetate, cellulose diacetate, nitrocellulose, polystyrene, or polyethylene terephthalate.

7. The photographic element of claim 2 in which said clear photographic base comprises polyethylene terephthalate.

8. A photographic element free of latent image and capable of producing a high contrast silver image comprising a washed high contrast silver halide photographic emulsion on a clear photographic base, said emulsion containing a hydrazine, said emulsion also comprising at least 0.001 mole per mole of silver halide of a water-soluble bromide and/or water-soluble chloride and being sensitized to light from a tungsten filament lamp.

9. A photographic element as claimed in claim 8 characterised in that the water soluble chloride and/or bromide comprises an alkali metal chloride or bromide and is present in an amount of from 0.001 to 0.2 mole per mole of silver halide and said alkali metal chloride or bromide is selected from potassium bromide, potassium chloride, sodium bromide, sodium chloride, lithium bromide, lithium chloride and mixtures thereof.

10. A photographic element free of latent image and capable of producing a high contrast silver image comprising a high contrast silver halide photographic emulsion on a clear photographic base in association with a hydrazine of general formula (I) characterized in that the emulsion contains a water-soluble alkali metal chloride or bromide which is present in an amount of from 0.001 to 0.2 mole per mole of silver halide $$R^{13}—NR^{14}NR^{15}—G—X \quad (I)$$

in which:

$R^{13}$ represents an aryl group, one of $R^{14}$ and $R^{15}$ is a hydrogen and the other is selected from hydrogen, aryl sulphonyl and trifluoroacetyl, G represents carbonyl, sulphonyl, sulphoxy, phosphoryl or an N-substituted or unsubstituted imino group, and X is hydrogen, alkyl, aryl or a moiety such that at a pH in the range of 9.5 to 12.5 in the presence of an oxidised hydroquinone a cyclisation reaction takes place cleaving the moiety —G—X from the remainder of the molecule and forming a cyclic structure comprising atoms of the moiety —G—X.

11. A method of treating a high contrast silver halide photographic emulsion associated with a hydrazine of general formula (I) to reduce the propensity of the emulsion to form pepper fog characterized in that the emulsion is contacted prior to exposure with an aqueous solution of a chloride or bromide in an amount to provide at least 0.001 mole of water soluble chloride and/or bromide per mole of silver halide $$R^{13}—NR^{14}NR^{15}—G—X \quad (I)$$

in which:

$R^{13}$ represents an aryl group, one of $R^{14}$ and $R^{15}$ is a hydrogen and the other is selected from hydrogen, aryl sulphonyl and trifluoroacetyl, G represents carbonyl, sulphonyl, sulphoxy, phosphoryl or an N-substituted or unsubstituted imino group, and X is hydrogen, alkyl, aryl or a moiety such that at a pH in the range of 9.5 to 12.5 in the presence of an oxidised hydroquinone a cyclisation reaction takes place cleaving the moiety —G—X from the remainder of the molecule and forming a cyclic structure comprising atoms of the moiety —G—X.

* * * * *

UNITED STATES PATENT AND TRADEMARK OFFICE

CERTIFICATE OF CORRECTION

PATENT NO. : 5,068,167

DATED : Nov. 26, 1991

INVENTOR(S) : Kevin P. Hall

It is certified that error appears in the above-identified patent and that said Letters Patent is hereby corrected as shown below:

Col. 6, lines 1-8, Add ring around Z N

Col. 14, line 13, Insert below the table, two lines
"Phosphoric acid (85%) 90g
Final volume 2.0 litres pH 11.0"

Signed and Sealed this

Thirty-first Day of August, 1993

*Attest:*

*Attesting Officer*

Bruce Lehman

BRUCE LEHMAN

*Commissioner of Patents and Trademarks*